US007249976B1

(12) United States Patent
Watson

(10) Patent No.: US 7,249,976 B1
(45) Date of Patent: Jul. 31, 2007

(54) ELECTRICAL PLUG, RECEPTACLE AND SWITCH

(76) Inventor: H. Scott Watson, P. O. Box 50237, Santa Barbara, CA (US) 93150-0237

( * ) Notice: Subject to any disclaimer, the term of this patent is extended or adjusted under 35 U.S.C. 154(b) by 0 days.

(21) Appl. No.: 11/539,631

(22) Filed: Oct. 7, 2006

Related U.S. Application Data

(60) Provisional application No. 60/744,014, filed on Mar. 30, 2006.

(51) Int. Cl.
*H01R 25/00* (2006.01)

(52) U.S. Cl. ..... 439/651; 200/51.07; 200/51.09

(58) Field of Classification Search ..... 439/651, 439/188; 200/51–99
See application file for complete search history.

(56) References Cited

U.S. PATENT DOCUMENTS

| | | | | |
|---|---|---|---|---|
| 2,905,779 | A | 9/1959 | Schmier | |
| 3,391,262 | A * | 7/1968 | Twitchell, Jr. | 200/51.02 |
| 4,080,039 | A * | 3/1978 | Ahroni | 439/620.3 |
| 4,520,243 | A * | 5/1985 | McIntyre | 200/51.07 |
| 4,738,629 | A | 4/1988 | Newman | |
| D295,622 | S * | 5/1988 | Good et al. | D13/137.3 |
| 4,755,691 | A | 7/1988 | Bethea | |
| 5,574,319 | A | 11/1996 | Bennett | |
| 6,416,362 | B1 | 7/2002 | Conrad et al. | |
| 6,710,553 | B2 | 3/2004 | Logan | |
| 6,802,741 | B1 | 10/2004 | Shatkin | |

* cited by examiner

*Primary Examiner*—Tho D. Ta
*Assistant Examiner*—Vanessa Girardi
(74) *Attorney, Agent, or Firm*—Richard S. Erbe

(57) ABSTRACT

A combination electrical plug, receptacle and switch includes a cylindrical plug portion in which is inserted a cylindrical receptacle portion. The plug portion may be plugged into a conventional electrical socket. An electrical appliance or device may be plugged into the receptacle end. Electrical contacts in the plug portion and the receptacle portion can be made to contact to form a pathway for electrical current by a applying a twisting motion to the receptacle portion. The pathway for the electrical current may be disconnected by twisting the receptacle portion the other way. In this manner, the combination may be conveniently used as an on/off switch for almost any electrical device. Safety features include a way to block twisting of the receptacle end when the switch is in the off position unless the receptacle end is first pulled slightly away from the plug end before twisting it.

17 Claims, 4 Drawing Sheets

ELECTRICAL PLUG, RECEPTACLE AND SWITCH

RELATED APPLICATIONS

This application claims the benefit of U.S. Provisional Patent Application No. 60/744,014 filed Mar. 30, 2006, and entitled "Combination Electrical Plug, Integral Twist Switch and Receptacle," incorporated herein by reference.

BACKGROUND OF THE INVENTION

1. Field of the Invention

The present invention relates to electrical devices. More particularly, it relates to a combination of electrical plug and receptacle that incorporates a switch for use with known electrical appliances and devices.

2. General Background and State of the Art

We use electrical appliances every day almost everywhere we go, in our homes, offices, on construction sites, and the like. Electrical appliances can assist a person to accomplish nearly any task, including grooming, washing clothes, entertainment, and the like.

In the United States of America and most of the developed nations of the world, electrical current is readily available. All a person needs to do is plug in an electrical appliance or device to a current carrying outlet and their lives are made considerably easier. Most electrical appliances come with plug, a cord, and an on/off switch.

The way some electrical devices or appliances are configured, access to the on/off switch is not always convenient for the user in actual use. Some electrical devices do not even have an on/off switch. There have been electrical plugs made that incorporate an on/off switch, so that the on/off function can be achieved at the same location where the device or appliance is plugged in. However, even these kinds of plugs have their drawbacks.

Some of the known combinations of plug and switch are bulky and interfere with the other electrical socket of a duplex receptacle, and are expensive to manufacture and to buy.

Other known combination plug and switch devices may be difficult for people afflicted with arthritis or other disability to operate.

Still other combination plug and switch devices may be used only with three-pronged receptacles or only with two-pronged receptacles, and not both.

Another problem associated with known combination plug and switch devices is that they do not include any positive positioning features in either the on or off positions.

Electric current carrying devices also are a potential danger to very young children; a child may accidentally cause current to flow through an electrical device or appliance while playing with one of the existing combination plug and switch devices and cause injury or damage.

Another problem with many of the known combination electrical plug and switch devices is that because of their configuration, they are difficult to use and operate in very tight or confined spaces.

Furthermore, many of the combination electrical plug and switch devices that are known or in use today do not allow for another appliance to be plugged into them.

There is therefore a need for an electrical device that is a combination of plug, receptacle, and switch.

There also exists a need for an electrical device that is a combination of plug, receptacle and switch that is compact and does not interfere with the unused half of a duplex receptacle when in use.

There further exists a need for an electrical device that is a combination of plug, receptacle and switch that can provide positive on/off positioning.

Additionally, there is a need for an electrical device that is a combination of plug, receptacle and switch that can function as a three to two prong adapter by using a pigtail where the ground prong is generally located.

Furthermore, there exists a need for an electrical device that is a combination of plug, receptacle and switch that provides safety features both when young children are nearby and also for electrical appliances that are normally left plugged in.

There also exists a need for an electrical device that is a combination of plug, receptacle and switch that is easy to use, simple in construction, and low in cost to manufacture and purchase.

Furthermore, there exists a need for an electrical device that is a combination of plug, receptacle and switch where the switch is built integral with the plug and receptacle.

There is also a need for an electrical device that is a combination of plug, receptacle and switch that is operated in such a matter that the grounds come in contact first before any other part of the switch makes contact.

There further exists a need for an electrical device that is a combination of plug, receptacle and switch that can be hard-wired to an electrical cord and used as a switch for any electrical device or appliance.

None of the prior art devices that combine electrical plugs, switches and/or receptacles addresses or meets these needs and provides the advantages of the present invention.

SUMMARY OF THE INVENTION

The disadvantages of prior art electrical devices are overcome by the present invention, which, in a broad aspect, provides the user with a compact, versatile device that can be plugged into existing electrical outlets and accommodate a plug from another appliance or device and also function as an on/off switch for that appliance or device.

A combination electrical plug, receptacle and switch in accordance with the present invention includes a plug portion, into which is fitted a receptacle portion. Both the plug and receptacle portions are generally cylindrical in shape. When the two portions are fitted together and the plug portion of the assembly is plugged into an electrical socket, any other electrical device may be plugged into the receptacle portion. Once this happens, the receptacle portion may be twisted in a rotational movement within the plug portion and the assembly acts as an on/off switch for whatever electric device is plugged into it.

The plug portion of a combination electrical plug, receptacle and switch in accordance with the present invention is constructed in a generally cylindrical shape having a first end and a second end. The first end includes an end wall through which a ground pin and a pair of blades extend. The ground pin and blades may be plugged into a conventional electrical socket.

The ends of the ground pin and blades that are contained within the cylindrical wall of the plug portion extending between the first and second ends form the electrical contacts for the plug portion (for purposes of discussion in this application, they are known as the ground contact and the circuit contacts), which, in conjunction with corresponding contacts in the receptacle portion, allow the assembly to act as an electrical twist switch.

The plug portion also includes a nib on the inner surface of the cylindrical wall. The nib is generally in the shape of an elongated cube having side walls (one of which is adjacent the cylindrical wall of plug portion), a pair of end walls, a top surface and a bottom surface. In the preferred embodiment of the invention, located on the top surface is a protrusion, which helps to provide positive on/off positioning of the twist switch, as will be discussed later. In alternative embodiments of the invention, the top surface of the nib may be angled in relation to an imaginary plane perpendicular to an axis extending through the plug portion or be chamfered to provide safety features to a combination electrical plug, receptacle and switch in accordance with the present invention.

The receptacle portion of a combination electrical plug, receptacle and switch in accordance with the present invention is also generally in the shape of a cylinder having first and second ends. The outer circumference of the cylindrical side wall of the receptacle portion is sized to provide a close, sliding fit when the receptacle portion is placed inside the cylindrical wall of the plug portion.

The receptacle portion secures a contact plate which holds a ground contact and a pair of circuit contacts, corresponding to the ground contact and the circuit contacts in the plug portion. When the plug portion is plugged into a conventional electrical socket, current may be made to pass through the combination electrical plug, receptacle and switch in accordance with the present invention when the ground contacts and the circuit contacts are placed so that they touch. As a safety feature of the device, the ground contacts come into contact before the circuit contacts come into contact when the twist switch is being moved into the on position. Conversely, when the twist switch is being turned to the off position, the ground contacts remain in contact until after the circuit contacts are no longer in contact. When another electrical device is plugged into the receptacle portion through openings in the first end wall at the first end of the receptacle portion, the ground pin and blades from the other device are received by three receivers inside the receptacle portion, which correspond and connect to the ground contact and the circuit contacts.

An O-ring mounted in a groove around the outside of the cylindrical wall of the receptacle portion provides a weatherproof seal that allows the combination electrical plug, receptacle and switch in accordance with the present invention to be used outside as well as inside.

The combination electrical plug, receptacle and switch in accordance with the present invention provides movement and positive positioning between the plug portion and the receptacle portion due to the interaction between the nib mounted inside the plug portion and certain construction features of the end wall located at the second end of the receptacle portion. The second end of the receptacle portion includes a cutaway portion in the end wall with a sliding surface and two stops, one stop for the on position, and the other for the off position. The nib of the plug portion slides along the sliding surface until one of its end walls contacts one of the stops. In the preferred embodiment of the invention, when the nib end wall contacts a stop, the protrusion on the top surface of the nib fits into a detent located in the sliding surface. The detent is configured so that the protrusion can fit within the detent and provide positive positioning for the twist switch. A stop and detent at the other end of the cutaway portion provides positive positioning for the switch in the second position.

A combination electrical plug, receptacle and switch in accordance with the present invention may also include safety features, such as inclined portions at the stops in the sliding surface into which a nib having an inclined top surface may be secured. In this embodiment of the invention, the inclined portion of the sliding surface located at the stop in the off position also includes a step, so that the nib will actually be made to fall a short distance into the inclined portion and step of the sliding surface. At that point, anyone trying to turn the switch to the on position will first have to pull the plug portion and the receptacle portion slightly apart before they can be twisted in relation to each other. This is a safety feature that can prevent a small child playing with the combination electrical plug, receptacle and switch in accordance with the present invention from accidentally turning on electrical current and exposing him or her to injury. This feature can also help prevent the accidental turning on of machinery. A chamfer on the top surface of the nib, in conjunction with similarly constructed inclined portions of the sliding surface of the receptacle portion, may be operated in a similar fashion.

A combination electrical plug, receptacle and switch in accordance with the present invention may also be provided with an indicator lamp to show at a glance whether the twist switch is in the on or off position.

A combination electrical plug, receptacle and switch in accordance with the present invention may be configured so that either the plug portion or the receptacle portion may be hard-wired to an electrical cord to form an integral plug and switch, or receptacle and switch, on the end of the cord.

The ground pin of the combination electrical plug, receptacle and switch in accordance with the present invention may be replaced by what is known in the electrical trade as a "pigtail" so that it may be used as a three-to-two prong adapter.

Further objects and advantages of this invention will become more apparent from the following description of the preferred embodiments of the invention, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiments of the invention with reference to the drawings in which.

DETAILED DESCRIPTION OF THE PREFERRED EMBODIMENTS OF THE INVENTION

Figures 1, 2:
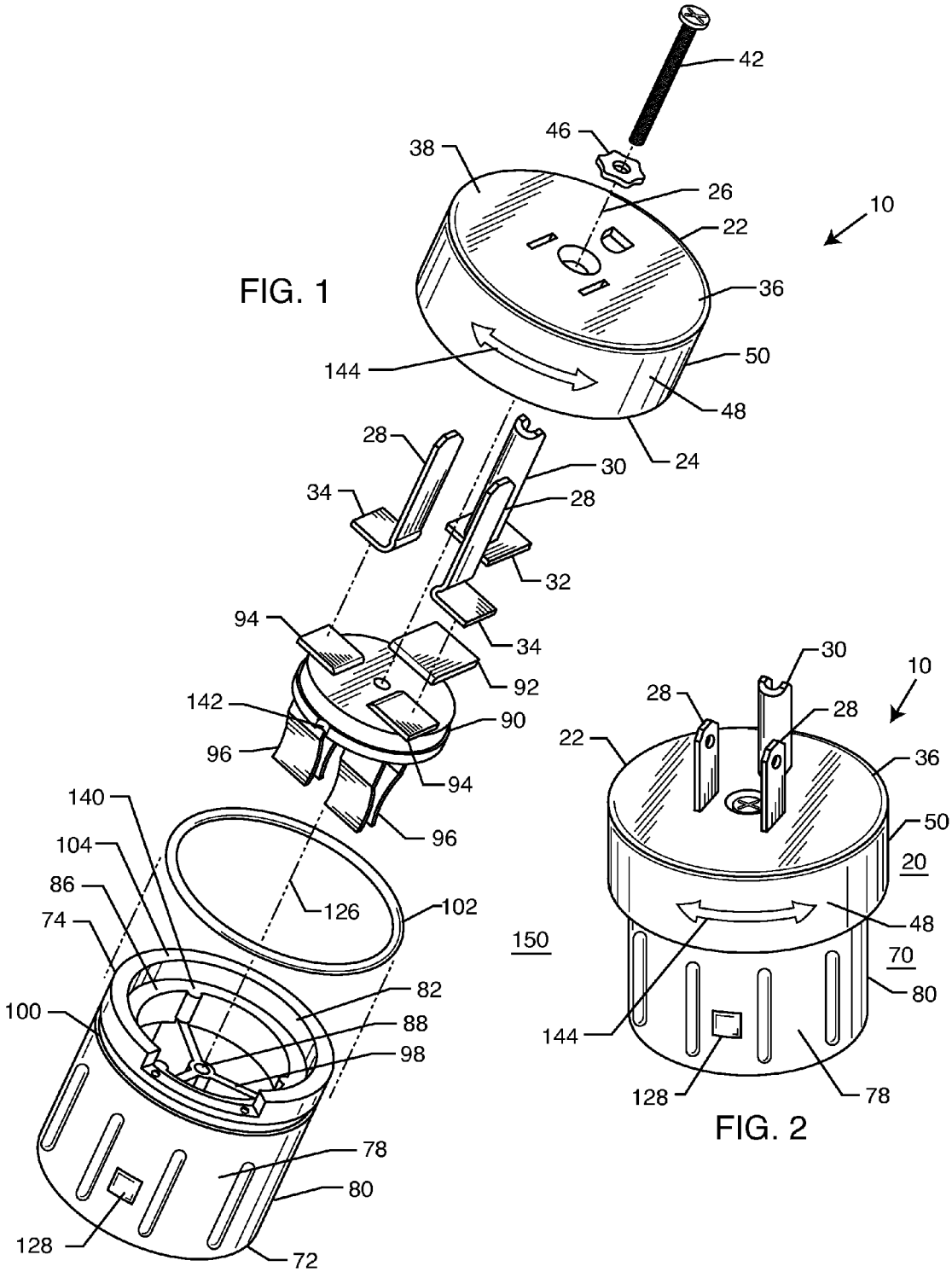
FIG. 1 illustrates an exploded perspective view of an exemplary combination electrical plug, receptacle and switch in accordance with the present invention.
FIG. 2 illustrates a perspective view of an exemplary combination electrical plug, receptacle and switch in accordance with the present invention.
Figure 3:
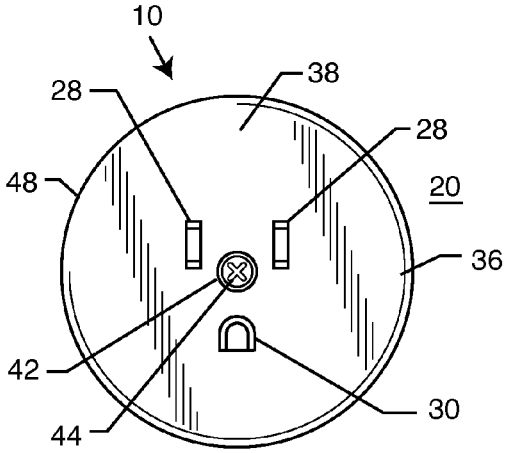
FIG. 3 illustrates an end view of the plug portion of an exemplary combination electrical plug, receptacle and switch in accordance with the present invention.

In the following description of the invention, reference is made to the accompanying drawings, which form a part thereof, and in which are shown, by way of illustration, exemplary embodiments illustrating the principles of the present invention and how it may be practiced. It is to be understood that other embodiments may be utilized to practice the present invention, and structural and functional changes may be made thereto without departing from the scope of the present invention.

A preferred embodiment of combination electrical plug, receptacle and switch in accordance with the present invention (for the sake of brevity in this description, it will be referred to as "the device" where appropriate) is illustrated in FIGS. 1-9 and is generally referred to by the reference numeral 10. As best illustrated in FIGS. 1, 2, 5 and 6, device 10 includes two primary components, plug portion 20 and receptacle portion 70, which are preferably constructed of a molded plastic. Plug portion 20 and receptacle portion 70, when combined and operated in a manner as later described, comprise switch 150.

As best illustrated in FIGS. 1, 2, 3 and 6, plug portion 20 includes first end 22 and second end 24, which are connected by cylindrical side wall 48, which has an outer circumference 50 and an inner circumference 52. A longitudinal axis 26, as shown in FIG. 1, passes through the center of plug portion 20 and is oriented parallel to cylindrical side wall 48.

At first end 22 is first end wall 36 having inner surface 40 and outer surface 38. Ground pin 30 and a pair of blades 28 extend through openings in first end wall 36. Ground pin 30 and blades 28 may be secured to first end wall 36 in a variety of conventional ways. One such conventional way of securing ground pin 30 and blades 28 to first end wall 36 is to include small tabs (not shown) on the ground pin and blade surfaces. These tabs function in the manner of barbs and prevent ground pin 30 and blades 28 from being pushed back from first end wall 36. Ground pin 30 and blades 28 are configured as a standard electrical plug and can be inserted into a standard electrical socket. Ground pin 30 and blades 28 form ground contact 32 and circuit contacts 34 at inner surface 40 of first end wall 36.

Opening 42 in first end wall 36 allows for screw 44 and spring washer 46 to be inserted in plug portion 20 and secure it to receptacle portion 70 by means of hole 88. The use of spring washer 46 is important, as it allows some movement of the device 10 parallel to longitudinal axis 26, which is a safety feature that will be discussed later.

Figure 7:
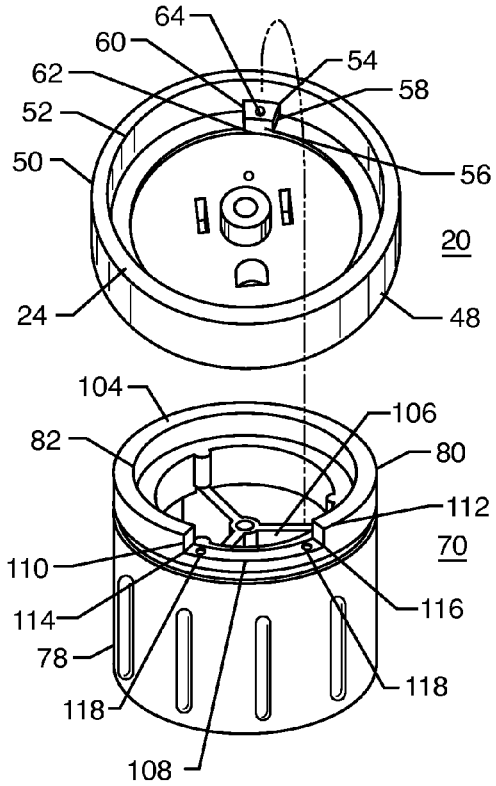
FIG. 7 illustrates a detailed view of the nib, sliding surface, stops and detents of an exemplary combination electrical plug, receptacle and switch in accordance with the present invention, with the electrical contacts not shown for the sake of clarity.

Located on inner circumference 52 is nib 54. Nib 54, as best illustrated in FIG. 7, includes side walls 56, end walls 58, a generally flat top surface 60, and bottom surface 62. In the preferred embodiment of the invention, nib 54 includes a protrusion 64 extending from top surface 60. Nib 54 works in conjunction with components of receptacle portion 70 to enable device 10 to function as a twist switch.

Figure 7A:
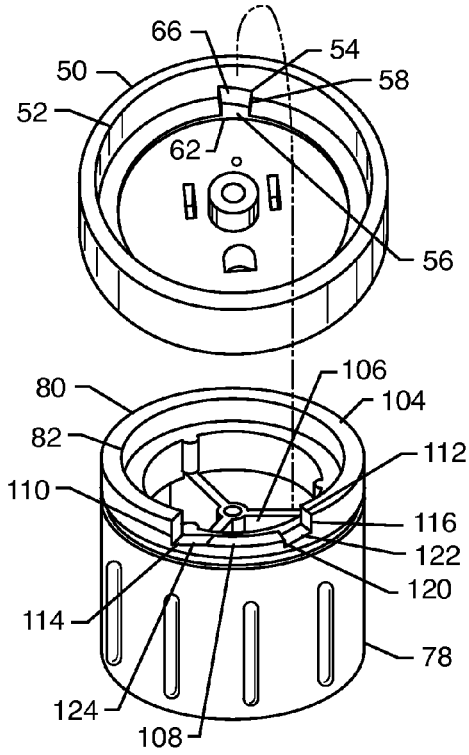
FIG. 7A illustrates a detailed view of an alternative construction of the nib with an inclined top surface and stops, inclined portions and a step on the sliding surface of an exemplary combination electrical plug, receptacle and switch in accordance with the present invention, with the electrical contacts not shown for the sake of clarity.

FIG. 7A illustrates an alternative embodiment of nib 54, where nib 54 includes an inclined top surface 66. Inclined top surface 66 is inclined with respect to an imaginary plane perpendicular to longitudinal axis 26 and helps to provide a safety feature, which will be described later. In FIG. 7A, it should be noted that the electrical contacts and contact plate are not shown for the sake of more clearly illustrating the components presently described.

Figure 7B:
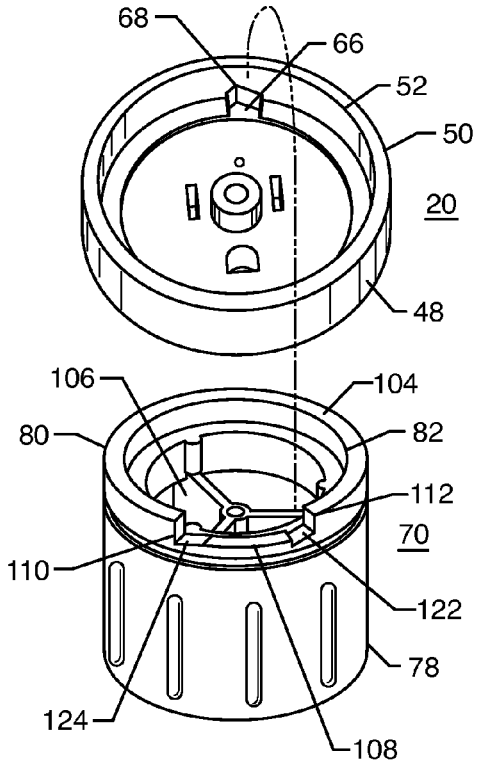
FIG. 7B illustrates a detailed view of another alternative construction of the nib with a chamfer and stops, inclined portions and a stop on the sliding surface of an exemplary combination electrical plug, receptacle and switch in accordance with the present invention, with the electrical contacts not shown for the sake of clarity.

FIG. 7B illustrates another alternative embodiment of nib 54, where top surface 60 includes chamfer 68, which provides a safety feature, as will be described later.

As best illustrated in FIGS. 1, 2, 4, 5 and 6, receptacle portion 70 includes first end 72, second end 74, and a cylindrical side wall 78 extending between first end 72 and second end 74. First end wall 76 of receptacle portion 70 is located at first end 72, and second end wall 104 is located at second end 74 of receptacle portion 70. Longitudinal axis 126 extends through receptacle portion 70 parallel to cylindrical side wall 78.

Cylindrical side wall 78 of receptacle portion 70 includes outer circumference 80 and inner circumference 82. It should be noted that outer circumference 80 is sized to be smaller in diameter than inner circumference 52 of plug portion 20, so that receptacle portion 70 may be slidably inserted in plug portion 20 and may be rotated within plug portion 20.

A plurality of openings 84 in first end wall 76 allow for a standard electrical three pronged plug to be inserted into receptacle portion 70.

Figure 6:
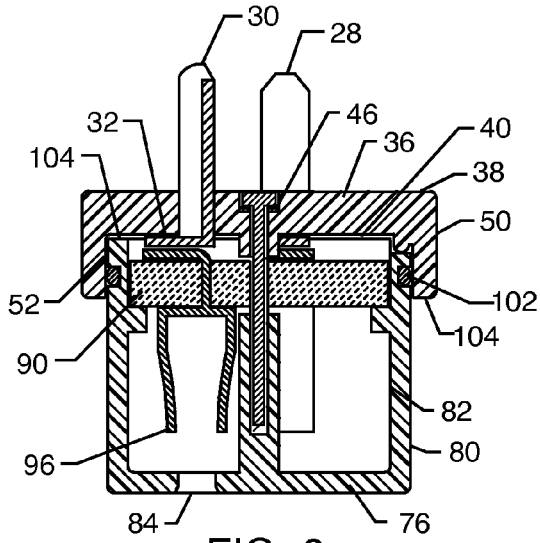
FIG. 6 illustrates a sectional side view of an exemplary combination electrical plug, receptacle and switch in accordance with the present invention.

As best illustrated in FIGS. 1 and 6, located within inner circumference 82 is inner support ring 86, which secures contact plate 90. Contact plate 90 holds three electrical contacts, which include ground contact 92 and circuit contacts 94. Receivers 96 extending from ground contact 92 and circuit contacts 94 provide electrical connectivity to the electrical contacts when a plug is inserted into openings 84. A number of stabilizers 98, in conjunction with locating pin 140 in inner support ring 86 and locating cutouts 142 in contact plate 90, hold contact plate 90 and receivers 96 in proper alignment so that an electrical connection can be successfully made when a plug is inserted into receptacle portion 70.

The device 10 can be used indoors and outdoors. O-ring 102, which fits within groove 100 in outer circumference 80, provides a weatherproof fit between receptacle portion 70 and plug portion 20, while still allowing receptacle portion 70 to be rotated within plug portion 20.

FIG. 7 illustrates the details of construction of nib 54 and component structures of receptacle portion 70 that enable device 10 to function as a twist switch 150. In FIG. 7, it should be noted that the electrical contacts and contact plate are not shown for the sake of more clearly illustrating the components presently described. A cutaway portion 106 is formed in cylindrical side wall 78 at second end wall 104. Cutaway portion 106 is bounded by sliding surface 108, and end stops 110 and 112, located respectively at on position 114 and off position 116. When device 10 is viewed from the same perspective as in FIG. 4, off position 116 is on the right side, and on position 114 is on the left side, although these positions may be reversed as the manufacturer/supplier sees fit.

In the preferred embodiment of the invention, a pair of detents 118 are located in sliding surface 108, one located near end stop 110 and the other located near end stop 112. In operation, receptacle portion 70 is inserted within plug portion 20, and aligned so that nib 54 is located within cutaway portion 106 between end stops 110 and 112. Plug portion 20 and receptacle portion 70 are secured together by screw 44, which is inserted through opening 42 in plug portion 20 and hole 88 in receptacle portion 70.

Once the plug and receptacle portions are secured together, plug portion 20 is plugged into a standard electrical socket. Receptacle portion 70 is then rotated or twisted in either a clockwise or counterclockwise direction. Nib 54 slides along sliding surface 108. In the preferred embodiment of the invention, when receptacle portion is turned to the right (as viewed from the perspective as in FIG. 4), nib 54 slides along sliding surface 108 until one of its end walls 58 comes adjacent to end stop 110 at on position 114. At this point, protrusion 68 will become inserted into a detent 118, providing positive position for switch 150, in the on position. At this point, ground contacts 32 and circuit contacts 34 come into contact with ground contact 92 and circuit contacts 94, forming an electrical pathway and placing switch 150 in the on position. At the same time, indicator lamp 128 is illuminated to indicate that switch 150 is in the on position. It should be noted that the configuration of device 10 is such that ground contacts 32 and 92 will be electrically connected before circuit contacts 34 and 94 come into contact. Conversely, when switch 150 is turned toward the off position, ground contacts 32 and 92 will break contact after circuit contacts 34 and 94 break contact. This is an important feature of device 10. Indicator 144 illustrates for the user that operation of device 10 is accomplished by rotating one portion of device 10 within the other and may also include indication of the "on" and "off" positions.

Figure 4:
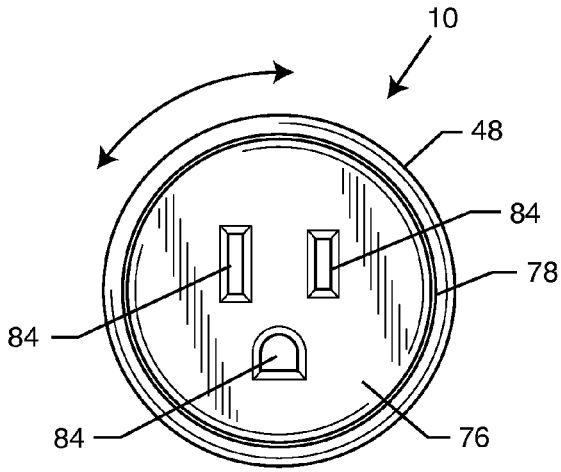
FIG. 4 illustrates an end view of the receptacle portion of an exemplary combination electrical plug, receptacle and switch in accordance with the present invention.
Figure 5:
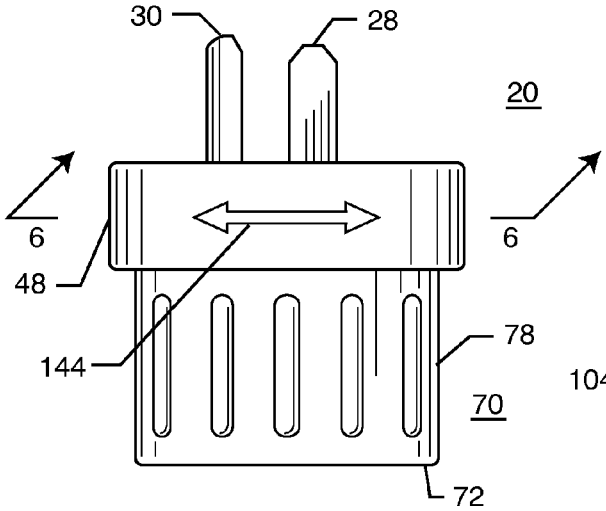
FIG. 5 illustrates a side view of an exemplary combination electrical plug, receptacle and switch in accordance with the present invention.

To turn switch 150 to off, receptacle portion 70 is turned to the left, as viewed from the perspective as in FIG. 4, until one of the end walls 58 of nib 54 comes adjacent to end stop 112 at off position 116. At this point, protrusion 64 will become inserted into the other of the detents 118 to provide positive positioning for switch 150 in the off position.

FIG. 7A illustrates an alternative embodiment of the invention that provides an additional safety feature to device 10. In FIG. 7A, it should be noted that the electrical contacts and contact plate are not shown for the sake of more clearly illustrating the components presently described. This safety feature is intended to prevent device 10 from being accidentally turned to the on position by a small child who might be tempted to play with it or for it to be accidentally and unintentionally turned on by some activity in its proximity. In this embodiment of the invention, sliding surface 108 includes a pair of inclined surface portions 122 and 124, located respectively at off position 116 and on position 114. Inclined surface portion 122 includes a step 120. Inclined surface portions 122 and 124 are inclined with respect to an imaginary plane perpendicular to longitudinal axis 126, which, as illustrated in FIG. 1, passes through the center of receptacle portion 70 and is parallel to cylindrical side wall 78. Inclined surface portions 122 and 124, in conjunction with the structure of nib 54 described below, provide positive positioning for switch 150 in the on and off positions in addition to providing a safety feature.

In the embodiment of the invention illustrated in FIG. 7A, the construction of nib 54 includes inclined top surface 66, which is inclined with respect to an imaginary plane perpendicular to longitudinal axis 26 and is complementary to inclined surface portions 122 and 124. In this alternative embodiment of the invention, when switch 150 is in the off position 116, inclined top surface 66 drops into the shape formed by inclined surface portion 122 and step 120. If someone then tries to turn switch 150 on by simply rotating receptacle portion 70, step 120 will prevent this movement and switch 150 can not be turned to on. In this embodiment of the invention, in order to turn switch 150 towards on position 114, the user must first pull receptacle portion 70 in a direction parallel to longitudinal axis 126 away from plug portion 20 for a short distance before rotating receptacle portion to the left as viewed from the perspective as in FIG. 4. The use of spring washer 46 in conjunction with screw 44 to connect the receptacle portion and the plug portion allows for the movement described. In the preferred embodiment of the invention, the length of movement required in the direction of longitudinal axis 126 is approximately 1/32".

FIG. 7B illustrates another alternative embodiment of the present invention. In FIG. 7B, it should be noted that the electrical contacts and contact plate are not shown for the sake of more clearly illustrating the components presently described. In this embodiment of the invention, nib 54 includes inclined top surface 66, which has a chamfer 68 where inclined top surface 66 adjoins on of the end walls 58. Sliding surface 108 includes step 120 and inclined surface portions 122 and 124 as previously described. When switch 150 is in off position 116, chamfer 68 and inclined top surface 66 are positioned within inclined surface portion 122 and step 120 to provide positive positioning and to prevent accidental or unintentional turning of receptacle portion 70. Unlike the embodiment of the invention illustrated in FIG. 7A and described above, when switch 150 is in the off position, when a user wishes to move the switch to the on position, he or she does not first have to pull receptacle portion 70 away from plug portion 20. Rather, a rotating or twisting force of somewhat greater magnitude is required to disengage chamfer 68 from inclined portion 122 and step 120 than would normally be required to rotate or twist receptacle portion 70 in any other position.

Figure 8:
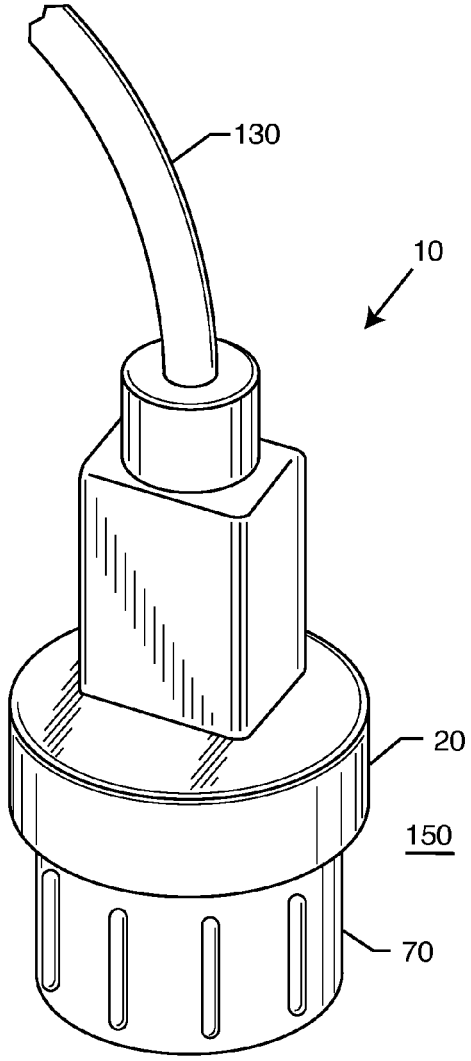
FIG. 8 illustrates a perspective view of an exemplary combination electrical plug, receptacle and switch in accordance with the present invention with an electrical cord hardwired to the plug portion.

FIG. 8 illustrates another alternative embodiment of the invention in which an electrical cord 130 is hardwired to plug portion 20. In this embodiment of the invention, device 10 is configured as an integral plug and switch.

Figure 9:
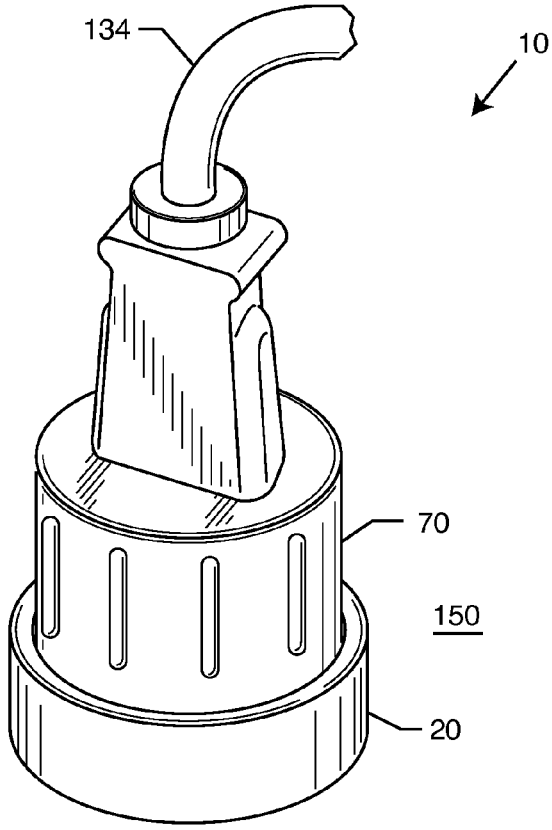
FIG. 9 illustrates a perspective view of an exemplary combination electrical plug, receptacle and switch in accordance with the present invention with an electrical cord hardwired to the receptacle portion.

FIG. 9 illustrates another alternative embodiment of the invention in which an electrical cord 134 is hardwired to receptacle portion 20. In this embodiment of the invention, device 10 is configured as an integral receptacle and switch.

Device 10 is generally designed for use with a standard three-hole electrical outlet. However, by replacing ground pin 30 with a "pigtail", device 10 may be used with as a three prong to two-prong adapter and used with a two-hole electrical outlet.

Potential uses for the embodiment of the invention described herein include, but are not limited to, the following.

Christmas tree lights.

Outdoor decorative lights.

Fountain pumps.

Pond pumps.

Security lights.

Electrical appliances not having switches.

A switch at the power source for power tool safety.

Power lockout in accordance with OSHA requirements.

Any electrical device with power supplied through an extension cord.

Switch off electronics (televisions, computers, etc.) during electrical storms.

Safety for electrical receptacles when switched off.

Trickle chargers.

Soldering irons.

Manual off switch for sensor operated lights.

Lighted signs not normally having switches.

Child safety device preventing accidental current flow and preventing a child from sticking an object or a finger into an electrical socket.

The foregoing description of the exemplary embodiments of the present invention have been presented for purposes of enablement, illustration, and description. It is not intended to be exhaustive of or to limit the present invention to the precise form discussed. There are, however, other configurations for combination electrical plug, receptacle and switches not specifically described herein, but with which the present invention is applicable. The present invention should therefore not be seen as limited to the particular embodiments described herein; rather, it should be understood that the present invention has wide applicability with respect to combination electrical plug, receptacle and switches. Such other configurations can be achieved by those skilled in the art in view of the description herein. Accordingly, the scope of the invention is defined by the following claims.

What is claimed is:

1. A combination electrical plug, receptacle and switch comprising:

a plug portion having first and second ends and a longitudinal axis extending through said plug portion, a first end wall disposed at said first end, said first end having an outer surface and an inner surface, a cylindrical side wall extending between said first and second ends, said cylindrical side wall having an outer circumference and an inner circumference, a pair of blades and a ground pin extending through said first end wall and forming electrical contacts on said inner surface of said first end wall, and a nib disposed on said inner circumference at said first end; and a receptacle portion rotatably and slidably inserted in said plug portion, said receptacle portion having first and second ends, a longitudinal axis extending through said receptacle portion, a first end wall disposed at said first end, said first end wall having a plurality of openings, a cylindrical side wall extending between said first and second ends, said cylindrical side wall having an outer circumference and an inner circumference, said outer circumference configured to be smaller than said inner circumference of the plug portion, an inner support ring disposed on said inner circumference, a contact plate and electrical contacts attached to said inner support ring, a second end wall disposed at said second end of said receptacle portion, and a cutaway portion in said cylindrical side wall at said second end forming a sliding surface and pair of end stops, whereby, when said receptacle portion is inserted in said plug portion, said nib contacts said sliding surface and, whereby, a twist switch is formed when said receptacle portion is rotated so that the nib slides along said sliding surface between the end stops and said electrical contacts in the receptacle portion and the plug portion can be made to contact to complete an electrical circuit when the nib is at one end stop forming an on position, or to break contact between the electrical contacts when the nib is at the other end stop, forming an off position.

2. The combination electrical plug, receptacle and switch according to claim 1, further comprising a groove in the outer circumference of said cylindrical side wall and said receptacle portion and an O-ring inserted in said groove.

3. The combination electrical plug, receptacle and switch according to claim 1, further comprising a lamp to indicate whether the switch is in the on position or the off position.

4. The combination electrical plug, receptacle and switch according to claim 1, further comprising a plurality of stabilizers attached to said inner support ring.

5. The combination electrical plug, receptacle and switch according to claim 1, further comprising a plurality of openings in said first end wall in said receptacle portion.

6. The combination electrical plug, receptacle and switch according to claim 1, wherein an electrical cord is hardwired to said plug portion.

7. The combination electrical plug, receptacle and switch according to claim 1, wherein an electrical cord is hardwired to said receptacle portion.

8. The combination electrical plug, receptacle and switch according to claim 1, wherein said nib further comprises:

a pair of opposed end walls;

a pair of opposed side walls, one of said side walls adjoining said inner circumference of said cylindrical side wall of said plug portion;

a top surface; and a generally flat bottom.

9. The combination electrical plug, receptacle and switch according to claim 8, wherein said top surface is generally flat and has a protrusion extending from it.

10. The combination electrical plug, receptacle and switch according to claim 9, wherein said sliding surface contains a pair of detents, each of said detents configured to allow for said protrusion to be inserted therein.

11. The combination electrical plug, receptacle and switch according to claim 10, wherein one detent is disposed near the end stop at the on position and the other detent is disposed near the end stop at the off position.

12. The combination electrical plug, receptacle and switch according to claim 8, wherein said top surface is inclined relative to an imaginary plane perpendicular to the longitudinal axis extending through the plug portion.

13. The combination electrical plug, receptacle and switch according to claim 12, wherein said sliding surface has a step and a portion near the end stop at the off position which is inclined with respect to an imaginary plane which is perpendicular to the longitudinal axis extending through the receptacle portion and complementary to the inclined top wall, and a portion near the end stop of the on position which is inclined with respect to an imaginary plane which is perpendicular to the longitudinal axis extending through the receptacle portion and complementary to the inclined top wall.

14. The combination electrical plug, receptacle and switch according to claim 8, wherein said top surface is inclined relative to an imaginary plane perpendicular to the longitudinal axis extending through the plug portion and includes a chamfer where the top surface adjoins one of the side walls of the nib.

15. The combination electrical plug, receptacle and switch according to claim 14, wherein said sliding surface has a step and a portion near the end stop at the off position which is inclined with respect to an imaginary plane which is perpendicular to the longitudinal axis extending through the receptacle portion.

16. The combination electrical plug, receptacle and switch according to claim 1, wherein said electrical contacts in said plug portion include a ground contact and a plurality of circuit contacts, and said electrical contacts in said receptacle portion include a ground contact and a plurality of circuit contacts.

17. The combination electrical plug, receptacle and switch according to claim 16, wherein said ground contact in said plug portion and said ground contact in said receptacle portion are configured so that when the twist switch is moved to the on position, the respective ground contacts close before the respective circuit contacts close, and when the twist switch is moved from the on position towards the off position, the circuit contacts open before the ground contacts open.

* * * * *